US005680717A

United States Patent [19]

Bierwith

[11] Patent Number: 5,680,717

[45] Date of Patent: Oct. 28, 1997

[54] EXCAVATION BUCKET

[76] Inventor: Robert S. Bierwith, 1331 Eastshore Hwy., Berkeley, Calif. 94710

[21] Appl. No.: 557,444

[22] Filed: Nov. 14, 1995

[51] Int. Cl.[6] ..... E02F 3/40

[52] U.S. Cl. ..... 37/444; 37/448; 37/450; 37/454; 37/341

[58] Field of Search ..... 37/444, 445, 446, 37/448, 341, 398, 452, 450, 451, 454, 460

[56] References Cited

U.S. PATENT DOCUMENTS

| | | | |
|---|---|---|---|
| 2,261,997 | 11/1941 | Halbert | 37/446 X |
| 2,501,489 | 3/1950 | Aisthorpe | 37/398 |
| 2,965,989 | 12/1960 | Hibbard | 37/448 X |
| 3,035,724 | 5/1962 | Clark et al. | 37/444 X |
| 3,280,486 | 10/1966 | Hackel | 37/452 |
| 3,465,833 | 9/1969 | Lutz | 37/448 X |
| 3,606,471 | 9/1971 | Evans | 37/452 X |
| 3,748,762 | 7/1973 | Tarrant | 37/444 X |
| 3,791,054 | 2/1974 | Bierwith | 37/141 R |
| 3,947,982 | 4/1976 | Mantovani | 37/450 |
| 4,037,337 | 7/1977 | Hemphill | 37/444 |
| 4,086,967 | 5/1978 | Eftefield et al. | 37/448 X |
| 4,117,611 | 10/1978 | Hemphill | 37/452 |
| 4,251,933 | 2/1981 | Hemphill | 37/446 |
| 4,302,893 | 12/1981 | van den Elshout et al. | 37/444 X |
| 4,321,762 | 3/1982 | Hemphill | 37/444 |
| 4,360,981 | 11/1982 | Bierwith et al. | 37/450 |
| 4,476,641 | 10/1984 | Ballinger | 37/444 |
| 4,570,365 | 2/1986 | Bierwith | 37/446 X |
| 5,333,399 | 8/1994 | Mett | 37/446 X |
| 5,375,347 | 12/1994 | Fleischhaker | 37/446 X |

OTHER PUBLICATIONS

Caterpillar Ground Engaging Tools, Sixth Edition 1995, pp. 1–23, Jun. 1995.

*Primary Examiner*—Terry Lee Melius
*Assistant Examiner*—Victor Batson
*Attorney, Agent, or Firm*—Townsend and Townsend and Crew

[57] ABSTRACT

An excavating bucket for rotating bucket excavators has a trough-shaped bucket having a forward edge formed by a U-shaped bucket lip. The lip has multiple shank holes and a cutting tooth in each shank hole which is removably attached to the lip. There are two sets of corner shank holes which lie on a circular line and receive a corresponding number of corner cutting teeth. Cutting portions of the corner teeth can be variously shaped so that the corner teeth can be adapted for varying cutting conditions. The cutting teeth have a weakening undercut adjacent their respective shafts so that forces acting on the teeth cause tooth deflections in the area of the recess while a remainder of the tooth, to which wear resistant layers of materials can be applied, is subjected to substantially no deflection to prevent a spalling of the wear resistant layers. An aft end of the bucket is defined by a multiplicity of side-by-side chains mounted on bars extending transversely between side plates of the bucket. The number of chains is selected so that the chains, when placed side by side, extend over less than the full length of the transverse bars and intermediate portions of the chains are biased into positions where they are closely adjacent each other when the bucket is in its upright position so that, when the bucket is upside down as it revolves with the bucket wheel, the chains drop gravitationally downwardly and flare outwardly towards the bucket sides, to assist in the removal of excavated material from the bucket.

20 Claims, 10 Drawing Sheets

EXCAVATION BUCKET

BACKGROUND OF THE INVENTION

The present invention relates to excavating buckets and in particular to such buckets for use with rotary bucket wheel excavators.

Bucket wheel excavators are typically used to remove large volumes of soil which cover minerals to be surface mined, the so-called overburden, and then to dig out the mineral itself, frequently coal. Each mine has a multitude of different soil conditions that must be contended with such as soft, hard, blocky, rocky, sticky, etc. ground, and there are equal differences from one mine to the next. The excavating buckets must be capable of coping with each of these soil conditions in an efficient manner to make mining profitable.

Because of the relatively high-speed movement of bucket wheel excavators as they dig through the soil, the front teeth forming the front end of the excavating buckets are not only subjected to very large forces and high rates of wear and tear, efficient manufacture as well as mining furthermore makes it necessary to give the teeth a shape (in the cutting direction) so that the resulting overall cutting line of the bucket assures that excavation takes place in the most efficient manner and under optimal conditions. Thus, during manufacture a given excavating bucket is fitted with a particular set of cutting teeth, depending on the mine where it is to be used. For each desired cutting line, the bucket was fitted with a bucket lip that had correspondingly arranged means for attaching the teeth to the bucket. Any new shape required the design and manufacture of a new, custom-made tooth mounting arrangement which rendered overall production costs for such buckets relatively high.

During mining, it may from time to time be necessary to change the cutting line because of changing soil conditions. In the past, this required the purchase of a separate set of excavating buckets, or the replacement of the cutting teeth mounting bucket lip. Both operations require the purchase of an additional set of parts, either complete excavating buckets or tooth mounting bucket lips, and their replacement on the bucket wheel excavator, a time-consuming and therefore relatively expensive operation.

SUMMARY OF THE INVENTION

The present invention is directed to an improved excavating bucket which is relatively inexpensive to manufacture and which allows a change of its cutting line by making only simple and inexpensive modifications.

By way of background, bucket wheel excavators have excavating buckets which excavate soil as cutting teeth of the bucket cut into the soil as the wheel rotates. The leading edge defined by the cutting teeth determines the cross-sectional shape of the soil that is being removed, the cutting line, and the surface of the tooth immediately aft of the cutting edge (lifting surface) lifts the cut soil off the remainder thereof for flow into the bucket as it rotates.

The bucket, with soil inside, continues to rotate, first upwardly and then over the top of the bucket wheel for discharge of the soil, during the ensuing downward stroke of the wheel, onto a conveyor which transports the soil, or mined mineral, away.

A first aspect of the present invention is directed to the manner in which the cutting teeth are mounted on the excavating bucket. This includes the U-shaped bucket lip, typically a forging, that is placed over the front edge of the excavating bucket. The front of the lip includes a multiplicity of forwardly facing holes which form sockets for shanks of chisel-shaped teeth having leading edges which, together, define the cutting line of the bucket. A group of teeth, typically four, define corner teeth which, during excavating, cut the critical corner of the cutting line.

The sockets in the lip for the corner teeth have centers which lie on a common circular line and the axis of each socket originates from the center axis of the circular line. The shank of each tooth is removably secured to the lip in a force-effective manner with a locking pin that extends through a hole in the inner end of the shaft that is aligned with cooperating slots in overlying portions of the bucket lip and which has a center that is preferably spaced from the end of the shaft by no more than the diameter of the hole. This minimizes relative pin motions and the possibility of lost pins and lost teeth.

The front portion of the teeth is shaped to provide the desired cutting line and includes correspondingly shaped and oriented leading edge and lifting surface configurations. By regularly positioning the sockets, particularly those for the corner teeth, rather than positioning them in dependence on the desired shape and orientation of the teeth, the cutting line is determined solely by the forward portion of the tooth so that the mounting portion thereof, the shank extending into the socket, remains the same irrespective of the shape of the tooth, its cutting edge and its lifting surface. Thus, for excavating along cutting lines of one shape or another, all that is needed are corresponding sets of cutting teeth, typically only of the corner teeth. Moreover, the regular positioning of the sockets along a circular line, the manufacture of the teeth, and particularly of the lifting surfaces thereof, becomes relatively easier and, therefore, less costly.

In a preferred embodiment of the invention excavating teeth between or adjacent the sets of corner teeth typically have straight leading edges. They are made shorter so that their leading edge is recessed, in the forward direction, relative to the adjacent leading edges defined by the corner teeth. In this manner the straight teeth do not interfere with the excavating or digging ability of the corner teeth.

A second aspect of the present invention is directed to excavating buckets, the aft, inside side of which is defined by strands of parallel, heavy link chains. The chains are loosely suspended between transverse mounting bars of the bucket, one adjacent the bucket lip and another one at an aft, inside portion of the bucket. Such chains are useful for expelling soil from the bucket during the downward stroke of the latter. In accordance with this aspect of the present invention, the number of chain strands is selected so that when placed side by side, they have a width that is less than the length of the mounting bars for the chains; i.e. so that the chains are loose on the mounting bars.

Side plates of the bucket have indents positioned so that they engage a mid-portion of the chains, when the bucket is upright (meaning its leading edge is in the vicinity of the low point of the bucket wheel), and they are spaced apart a distance only slightly larger than the combined width of all chain strands so that the mid-portion is pinched together in a waist-like fashion. When the bucket is upside down; e.g. during the downward stroke of the bucket, the mid-portions of the chains suddenly drop downwardly and simultaneously burst outwardly so that they impinge upon the side plates. This loosens and causes the discharge from the bucket of any soil that may adhere to the side plates, a feature that is particularly useful when excavating in wet or otherwise sticky soil.

A still further aspect of the present invention enhances the service life of the cutting teeth, and particularly the corner teeth, by providing a stress concentrating recess in the underside of the forward portion of the teeth immediately forward of the shank. In use, when the tooth is subjected to large forces and vibrations, almost all tooth deflections occur at the recess so that a remaining, forward section of the tooth remains relatively rigid and non-deflected. The heretofore common spalling of wear and tear resistant material layers applied to the teeth and forming the lifting surfaces thereof is thereby prevented.

In addition to greatly facilitating the manufacture and use of bucket wheels, the present invention results in bucket wheels having greatly improved performance characteristics, including a particularly noteworthy reduction in power consumption as a result of tooth configurations which optimize soil cutting and thereby correspondingly reduce power consumption. Further, the present invention permits a much more rapid, inexpensive and, therefore, more frequently performed replacement of teeth during normal mining operations. This allows a much more frequent modification of the cutting line and lifting surface configurations whenever there is a significant change in the encountered soil conditions.

DESCRIPTION OF THE PREFERRED EMBODIMENTS

Figure 1:
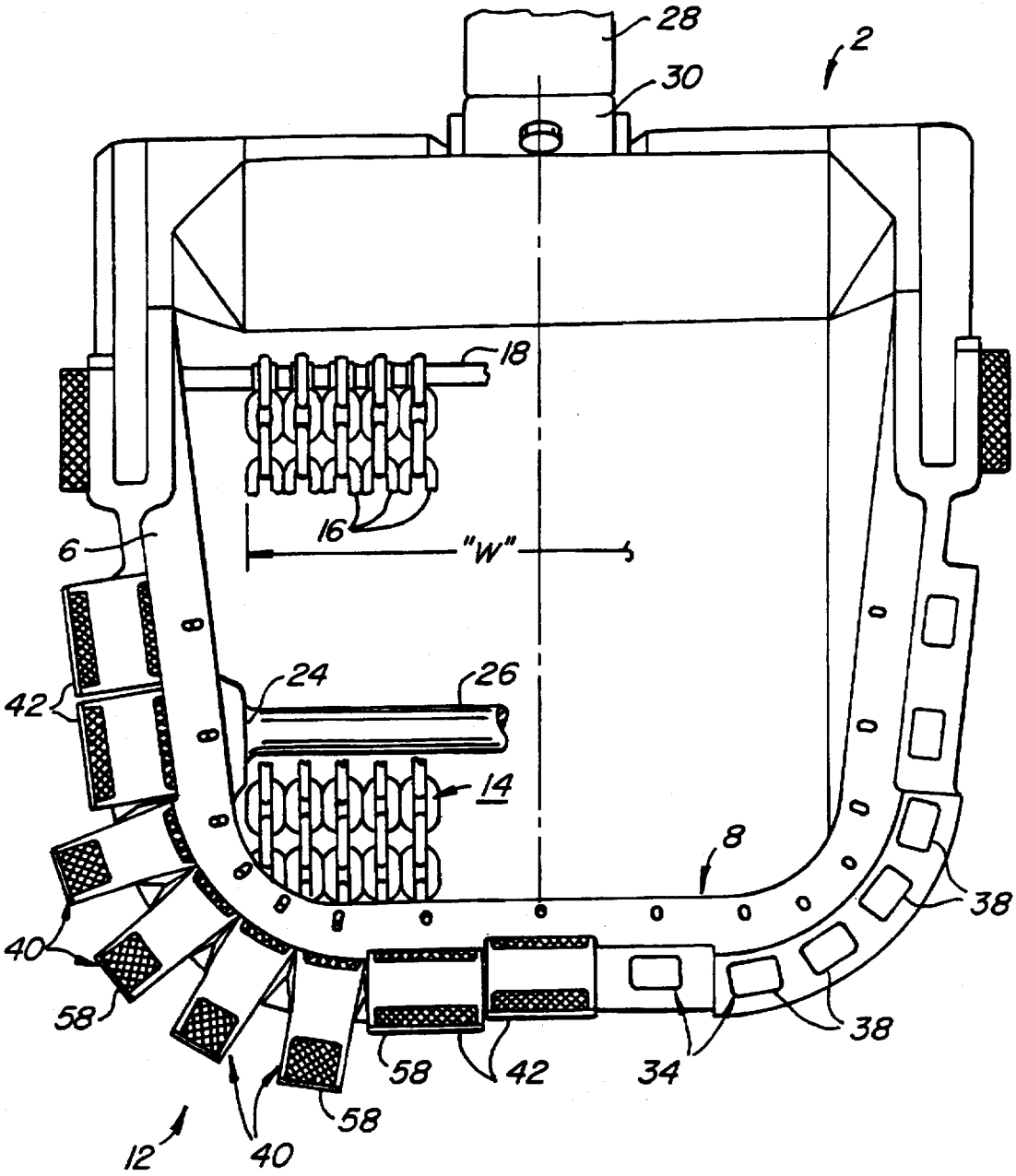
FIG. 1 is a front elevational view of a bucket excavator constructed in accordance with the present invention showing mounted excavating teeth in the left-hand portion of the drawing and empty, tooth mounting sockets of the bucket in the right-hand portion of the drawing.
Figure 2:
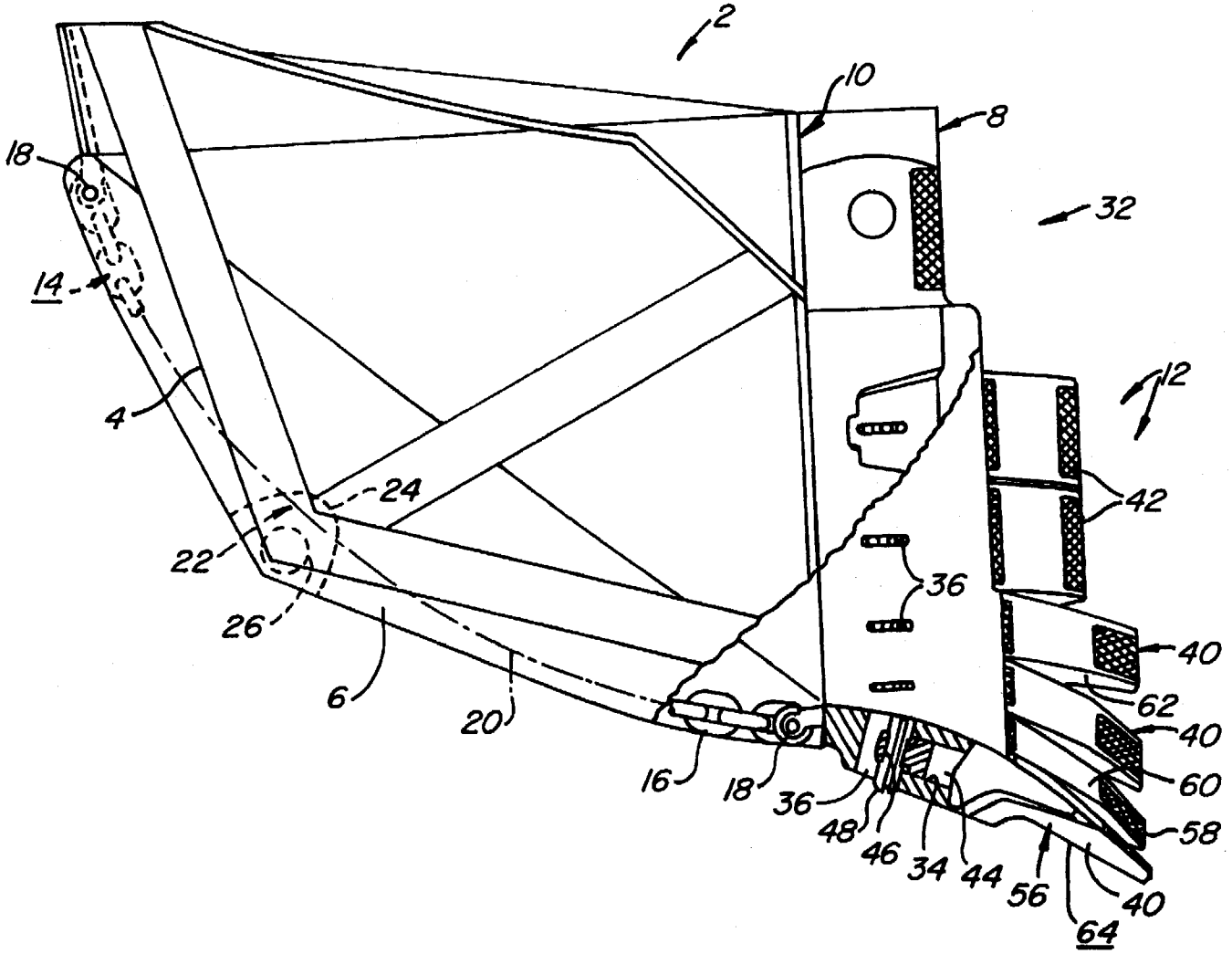
FIG. 2 is a side elevational view, partially in cross-section, illustrating the main features of the present invention.
Figure 3:
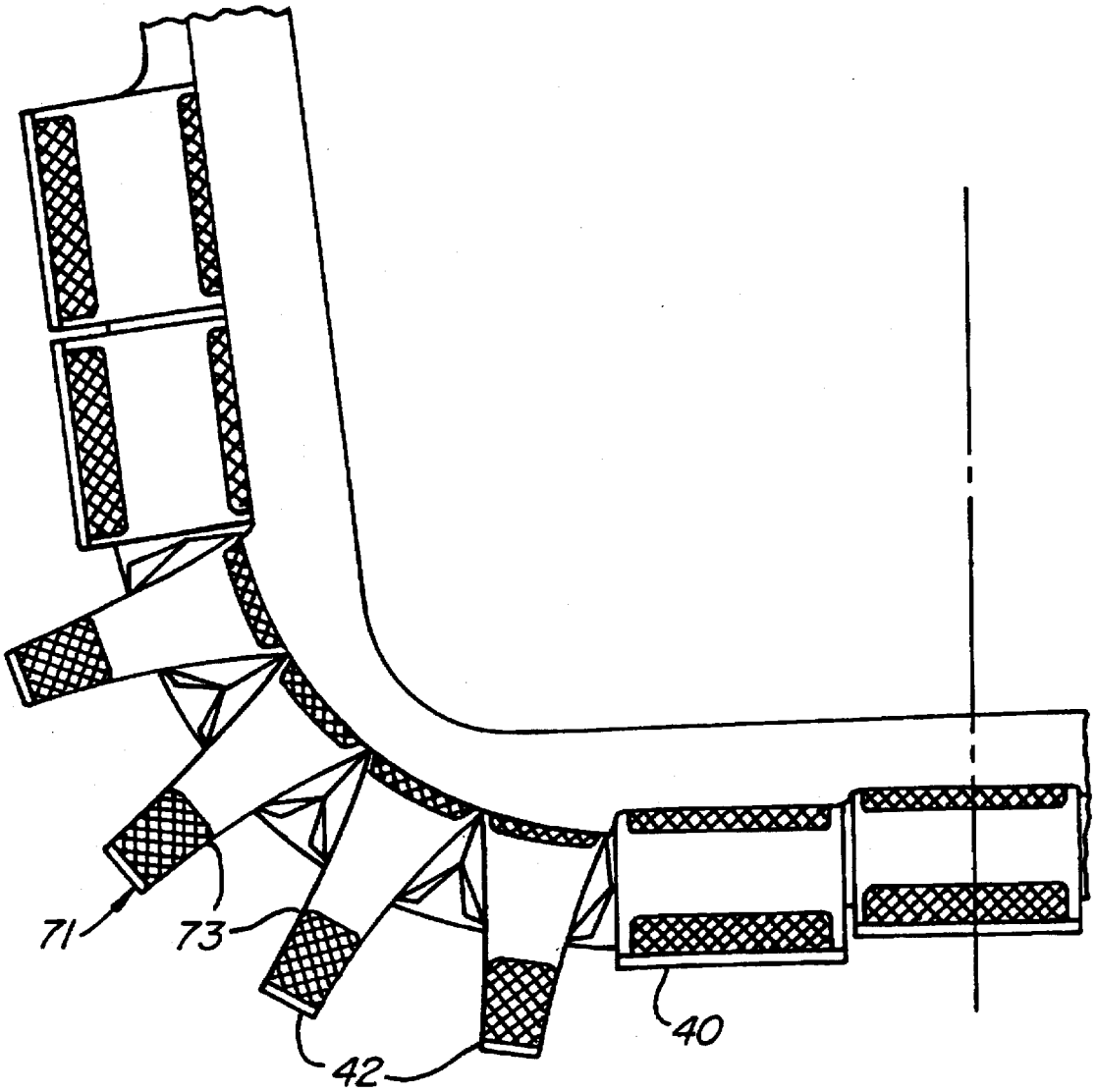
FIGS. 3–8 are schematic, fragmentary, front elevational views of excavating buckets having variously shaped sets of corner teeth constructed in accordance with the present invention which yield correspondingly different cutting lines for the bucket.

Referring to FIGS. 1 and 2, an excavating bucket 2 constructed in accordance with the present invention comprises a frame 4 covered by side plates 6 and having a generally U-shaped, upwardly open configuration (when viewed along the direction of movement; e.g. to the right as seen in FIG. 2). A bucket lip 8 is mounted to a forward edge 10 of the bucket, and it in turn mounts a plurality of forwardly extending cutting teeth 12 in a manner further described below.

An aft, forwardly facing, inside surface 14 of the bucket is defined by a multiplicity of heavy-duty link chain strands 16, the free ends of which are suspended from transverse bars 18 extending across the space between the frame and the side plates of the bucket and which are conventionally mounted; for example, with bolted connections (not separately shown). The chain strands have lengths so that they hang loosely between the bars, as is generally illustrated by arced phantom line 20 in FIG. 2. The combined width "W" of all chain strands 16 is less than the spacing between the bucket sides and transverse mounting bars 18 are correspondingly longer than "W".

At a location in the vicinity of a mid-portion 22 of the chain strands, the bucket sides include oppositely positioned, inwardly extending constrictions; for example, defined by large bosses 24 in the side plate (which may or may not be concentric with a stiffening truss 26 of the frame) which are spaced apart a distance only slightly larger than "W" so that the chain strands are pinched together at their mid-portions, while their free ends suspended from transverse bars 18 are permitted to flare out.

In use, a number of, say eight, ten or twelve, for example, buckets 2 are mounted to a large diameter bucket wheel 28 with appropriate mounting flanges 30 so that the bucket wheels project radially outward of a periphery of the wheels and open ends 32 of the buckets face in the direction of rotation of the wheel. The wheel is advanced along the ground so that those buckets on the wheel on the lower portion thereof dig into the soil and thereby excavate soil into the bucket. During this phase of mining, the bucket is generally upright, as shown in FIG. 1, chains 16 hang loosely between the transverse bars 18, and their mid-portions are pinched together so that excavated soil collects in the bucket and is retained therein by the chains.

As rotation of the bucket wheel continues, each now soil-filled bucket rises first upwardly, then rotates across the top of the wheel, and thereafter commences its downward stroke so that, eventually, open end 32 of the bucket faces downwardly and soil in the bucket drops gravitationally out of the bucket, typically onto a conveyor (not shown). Gravity also causes chains 16 to drop downwardly until the strands are again loosely suspended from transverse bars 18 but curved in the opposite direction from that shown by line 20 in FIG. 2. As the chains drop downwardly, their mid-portions 22 move beyond bosses 24, which causes the dropping chains to flare outwardly, impinge upon side plates of the bucket, and thereby loosen and expel forwardly soil which may stick thereto.

Turning now to the construction of the forward portion of the bucket, bucket lip 8 is secured to the forward edge of the bucket in accordance with any one of a variety of methods well known to those skilled in the art such as with C-clamps (not shown), by welding, riveting or otherwise. The portion of the lip extending beyond the forward edge of the bucket is relatively thickened, as best illustrated in FIG. 2, and includes a forwardly open socket hole 34 for each tooth 12. The socket hole preferably has a rectangular cross-section and tapers in a rearward direction as can be seen in the cross-sectional portion of FIG. 2. The inner end of the socket hole intersects a transverse slot 36 in the lip which is needed for purposes further described below.

The socket holes define two sets of, say, four corner sockets 38 for mounting corner teeth 40, and sockets in the lip between and adjacent to the corner sockets are provided for mounting intermediate teeth 42 having straight cutting edges to the lip.

Figure 9:
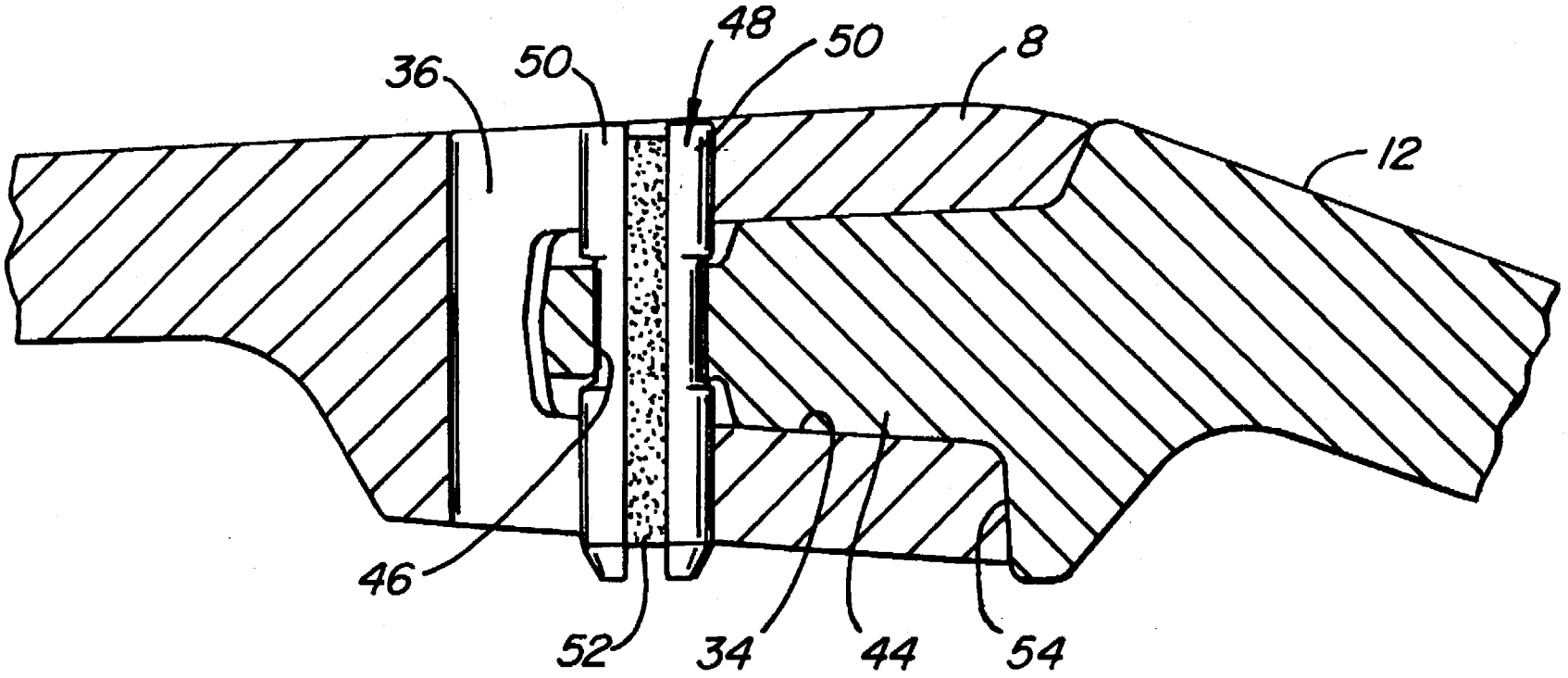
FIG. 9 is an enlarged, partial, side elevational view, in cross-section, which illustrates the mounting of the excavating teeth to the excavating lip of the bucket.
Figure 10:
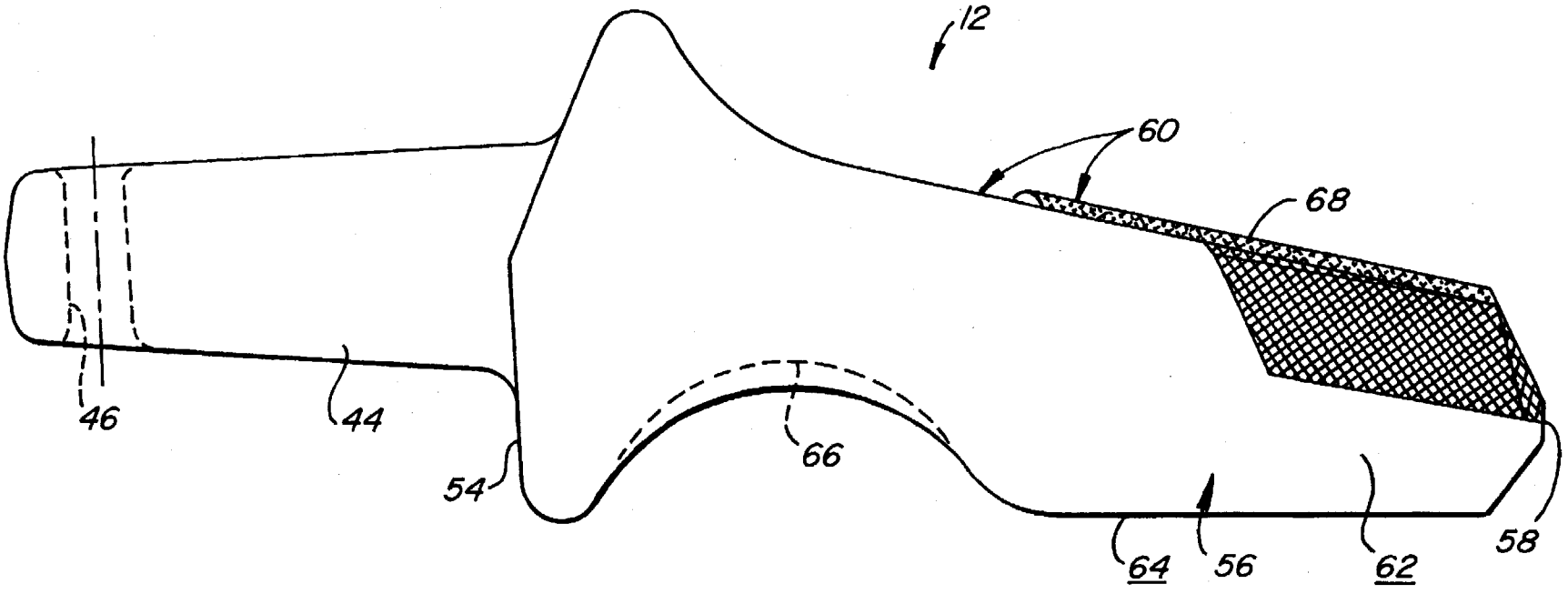
FIG. 10 is a side elevational view of an improved excavating tooth constructed in accordance with the present invention.

Referring to FIGS. 1, 2 and 9, each tooth 12 includes a shank 44 which extends into the associated socket hole 34. An aft end of the shaft overlaps slot 36 and includes a bore 46 with a center spaced from the aft end by preferably no more than the diameter of the bore. A mounting pin 48, defined by pairs of semicylindrical pin halves 50 bonded together with an elastomeric core 52, extends through both the slot and the shank bore and tightly secures the tooth to the lip by biasing an aft-facing shoulder 54 of the tooth against the lip.

A tooth is readily installed on bucket lip 8, either during the initial assembly of the bucket or when replacing one tooth with another, by inserting shank 44 into the appropriate socket hole 34 and, once bore 46 in the shank overlaps slot 36 in the lip, driving pin 48 into the slot and through the shank bore. The forwardly facing surface of bore 46 and the rearwardly facing surface of slot 36 are dimensioned and arranged so that a compressive force is exerted on pin core 52 to affirmatively retain the pin in place. For removal of the tooth, the pin is knocked out of the slot and the mounting hole in the tooth so that, thereafter, the tooth can be slidably withdrawn from the socket hole.

A forward portion 56 of the tooth is integrally constructed with and projects forwardly from shank 44. The forward portion defines a leading edge 58 of the tooth and a soil lifting surface 60 which extends rearwardly from the leading edge and terminates at the bucket lip 8. Lateral sides 62 of the tooth determine its width and they converge with an underside 64 which includes in the vicinity of the shank; that is, just forward of shoulder 54, a concave recess 66. As is best seen in FIG. 2, the teeth 12, and in particular each set of corner teeth 42, define a soil lifting surface for the bucket which flares forwardly and outwardly relative to the bucket lip.

When the tooth is subjected to excavating forces and vibrations, there will be stress concentrations in the cross-section of the tooth defined by the recess and virtually all flexing of the tooth under such forces occurs in the vicinity of the recess. The remaining section of the tooth forward of the recess therefore remains substantially rigid. This in turn prevents spalling of surface layers 68 applied to the tooth, defining at least a portion of lifting surface 60 thereof, and constructed of a material which is highly resistant to wear and tear from forces and abrasions encountered during excavating. The application of such wear resistant layers as such is well known to those skilled in the art.

The forward portion 56 of the teeth is constructed so that each tooth has the desired shape. As a first feature, straight teeth 42 have a lesser length than corner teeth 40 so that the leading edges of the former are recessed relative to the leading edges of the latter. This enhances the digging efficiencies of the corner teeth.

Further, the forward portion of the corner teeth 40 is shaped so that the cutting line along which the bucket excavates the soil, which is defined by the combined leading edges of all excavating teeth, has the desired shape. Thus, in the embodiment of the present invention illustrated in FIG. 1, the corner teeth have essentially parallel lateral sides 62 resulting in relatively widely spaced-apart leading edges 58 and a resulting cutting line which, along the corner portion thereof, is star-shaped for use under certain soil conditions. The lifting surface is inclined, relative to the forward direction, at an angle which is a function of the encountered soil condition and which is selected to effect an optimal rate of excavation with minimal power consumption.

Figure 4:
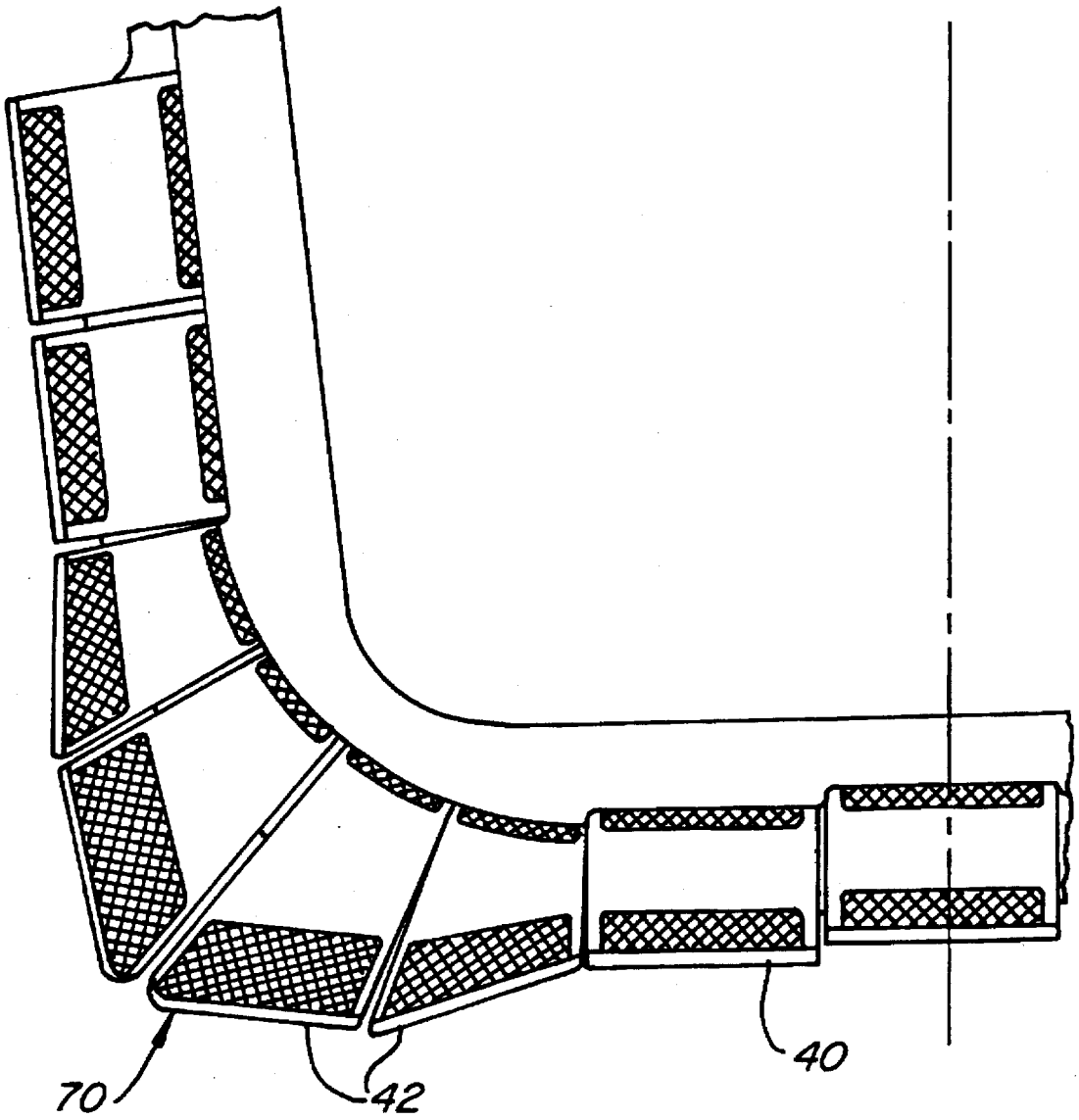
Figure 5:
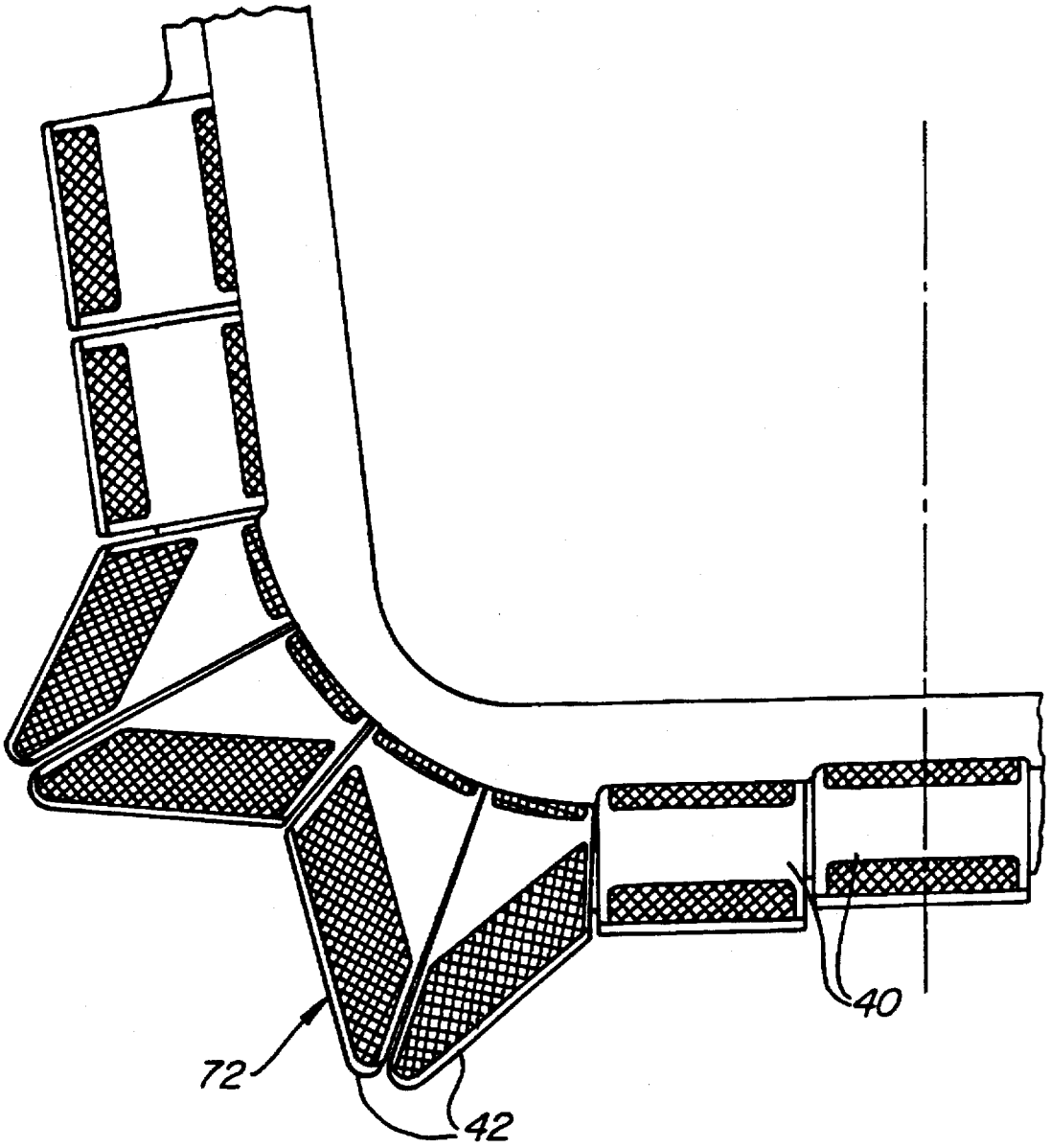
Figure 6:
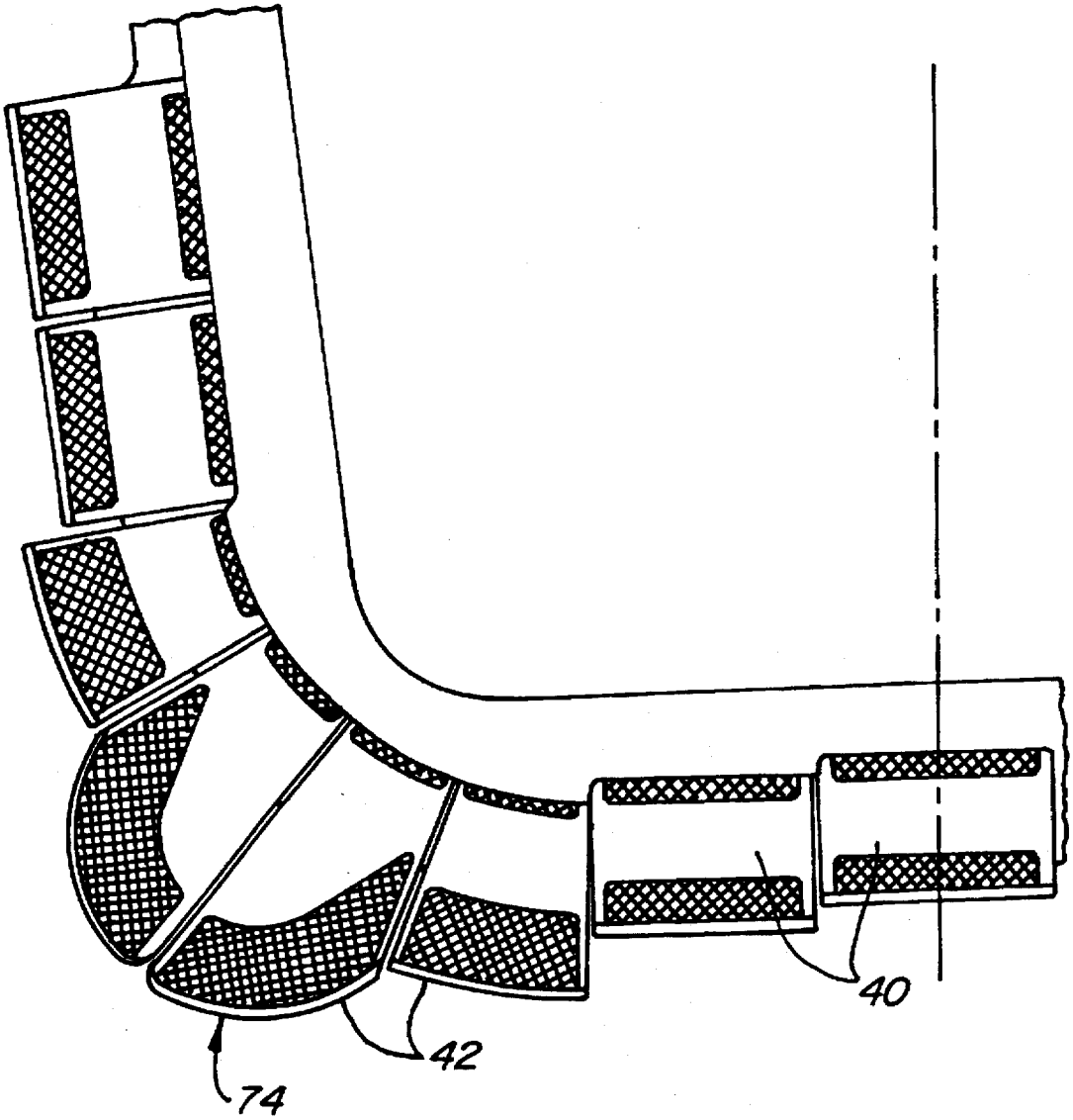
Figure 7:
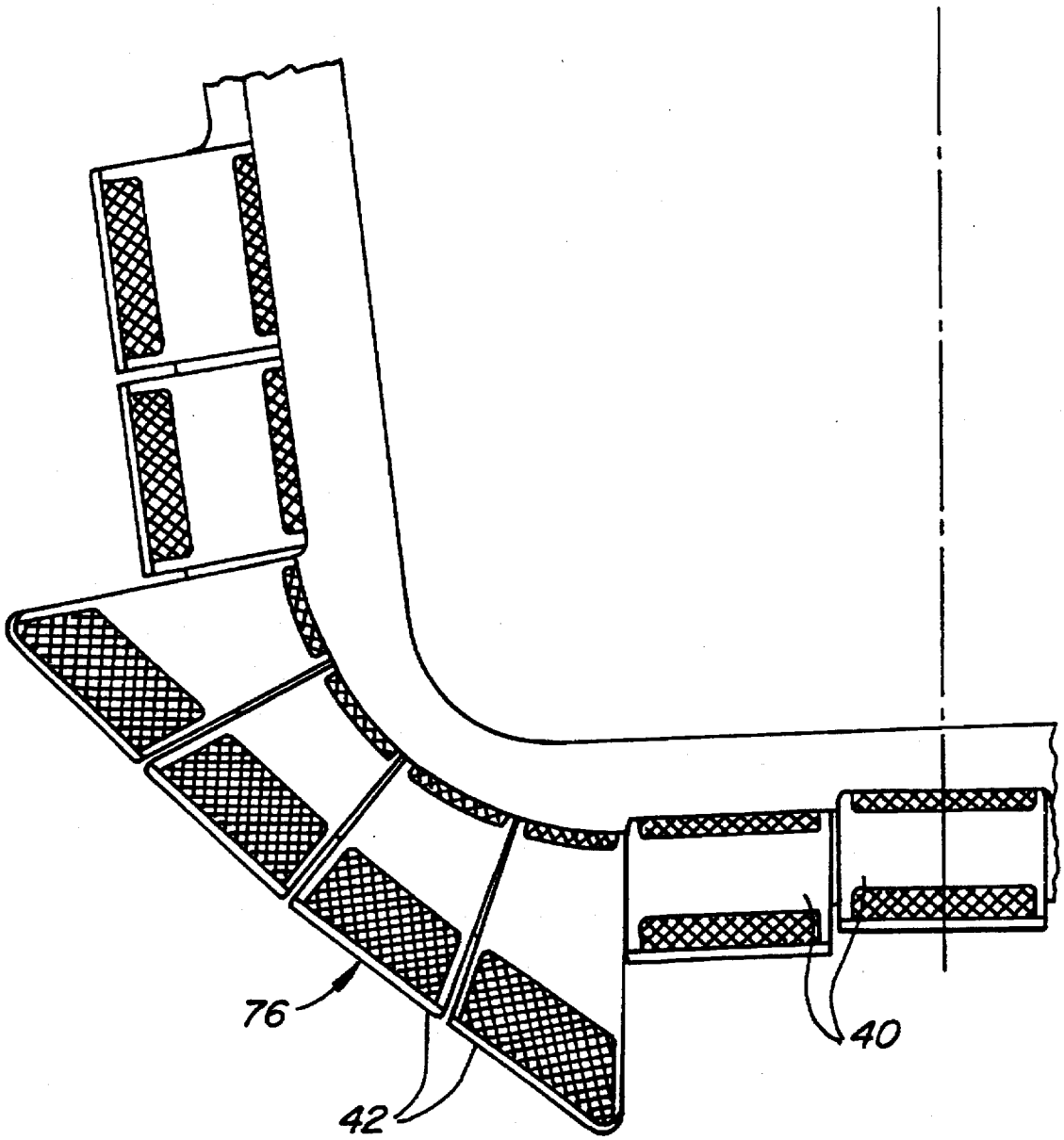
Figure 8:
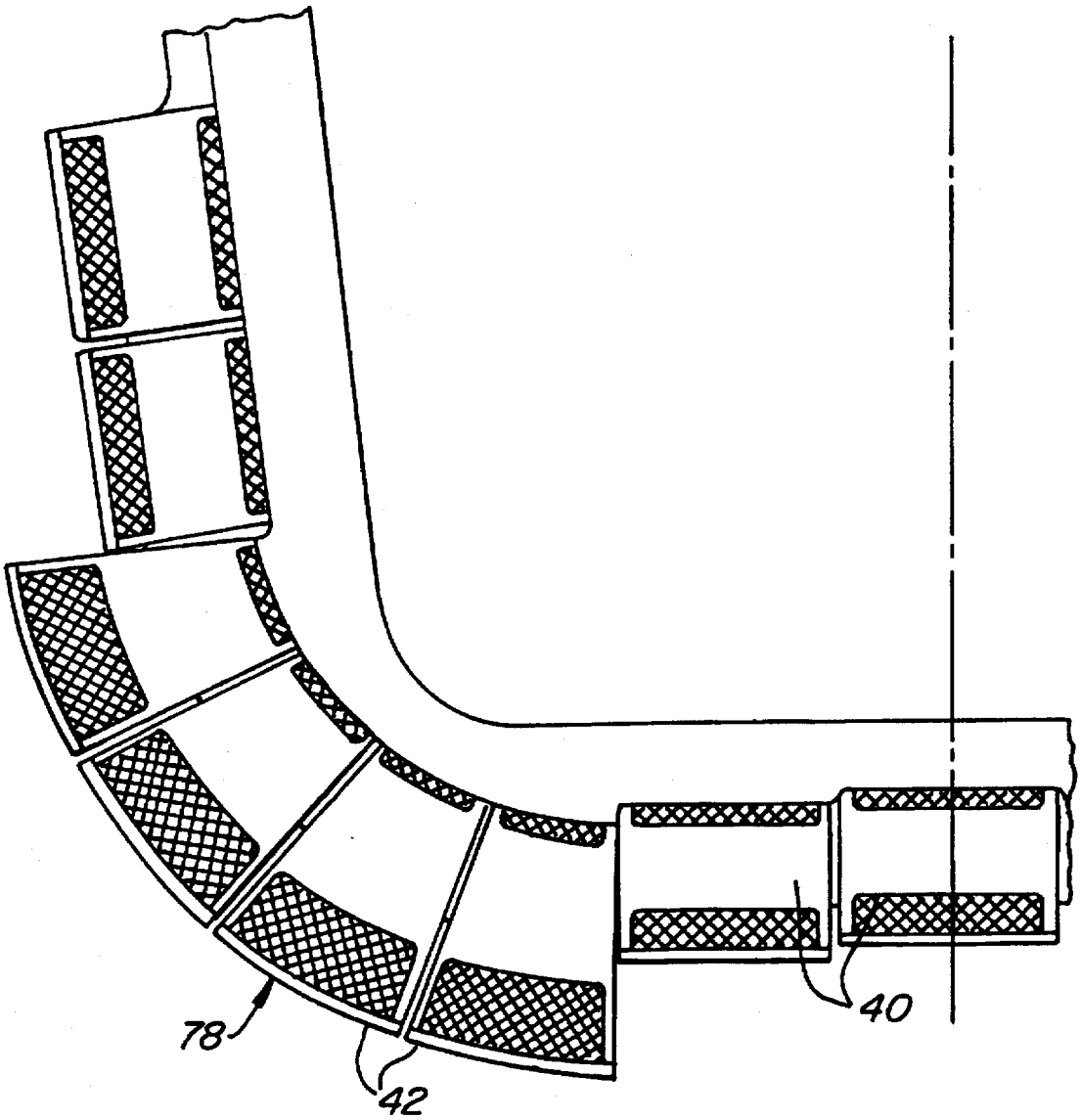

Since the teeth are readily interchangeable, by simply knocking out mounting pins 48 and replacing one tooth with the next, a bucket 2 fitted with teeth 12 having an optimal cutting line for one soil condition is quickly converted into a bucket having an optimal cutting line optimal for another soil condition at the instant the soil conditions change. Such changing soil conditions may require differing cutting line configurations, particularly in the corner region of the bucket lip, such as the even more pronounced star-shaped cutting line 71 (defined by corner teeth having forwardly converging sides 73), the generally L-shaped (corner) cutting line 70 illustrated in FIG. 4, the undulating (corner) cutting line 72 illustrated in FIG. 5, the trough-shaped (corner) cutting line 74 illustrated in FIG. 6, the straight edge-dovetailed (corner) cutting line 76 illustrated in FIG. 7, or the circular groove-shaped (corner) cutting line illustrated in FIG. 8, for example.

What is claimed is:

1. An excavation bucket assembly having a changeable cutting line along which the bucket assembly excavates soil, the bucket assembly comprising a generally trough-shaped bucket having an open forward end, a lip at the forward end of the bucket which includes a multiplicity of forwardly open, side-by-side socket holes, the socket holes including first and second sets of a plurality of corner socket holes, the plurality of corner socket holes having their respective centers located on a common circular line, each corner socket hole having a given shape and longitudinal orientation, a plurality of sets of corner teeth for each set of corner socket holes, each corner tooth having a shank adapted to be inserted into and withdrawn from a corner socket hole and a cutting portion integrally constructed with the shank, each cutting portion defining a forwardly oriented cutting edge and a soil lifting surface, a plurality of intermediate teeth mounted on the lip adjacent the corner holes, each intermediate tooth having a shank disposed in a corresponding one of the socket holes, the cutting edges of each set of the plurality of sets of corner teeth defining a pre-established, desired corner cutting line which is different from the pre-established, desired corner cutting lines of the other sets of corner teeth, and means for demountably securing the teeth to the lip, whereby the corner cutting line of the bucket can be changed from one desired corner cutting line to another desired corner cutting line by replacing one set of corner teeth with another set of corner teeth.

2. A bucket assembly according to claim 1 wherein the corner teeth have spaced-apart side edges which converge in a forward direction.

3. A bucket assembly according to claim 2 wherein forward edges of the corner teeth are substantially straight.

4. A bucket assembly according to claim 1 wherein the corner teeth include side edges which diverge in a forward direction.

5. A bucket assembly according to claim 4 wherein the side edges of the corner teeth converge in a rearward direction at a center of the circular line along which the centers of the shank holes are located.

6. A bucket assembly according to claim 5 wherein the side edges of adjacent corner teeth are closely adjacent and in mutual alignment.

7. A bucket assembly according to claim 6 wherein cutting edges of the corner teeth define a cutting line for the bucket which generally has an L-shaped configuration when viewed in a cutting direction.

8. A bucket assembly according to claim 6 wherein the corner teeth define a cutting line for the bucket which has an undulating shape when viewed in a cutting direction.

9. A bucket assembly according to claim 6 wherein the corner teeth define a cutting line for the bucket which is trough-shaped when viewed in a cutting direction.

10. A bucket assembly according to claim 6 wherein the corner teeth define a straight cutting line for the bucket when viewed in a cutting direction.

11. A bucket assembly according to claim 6 wherein the cutting teeth define a cutting line for the bucket which is circular in shape when viewed in a cutting direction.

12. A bucket assembly according to claim 1 wherein at least each corner tooth has a recess formed in its cutting portion proximate the shank of the tooth which is shaped so that forces applied to the tooth during digging cause deflections of the cutting portion relative to the shank in the area of the recess and relative deflections of a remainder of the cutting portion when subjected to said forces are substantially prevented.

13. A bucket assembly according to claim 12 wherein the cutting portion of each corner tooth has a lifting surface and an underside, and wherein the recess is formed in the underside of the tooth.

14. A bucket assembly according to claim 13 including a layer of a wear resisting material applied to the lifting surface of each corner tooth over a portion of the lifting surface located forwardly of the recess.

15. A bucket assembly according to claim 1 wherein each shank ends in an aft edge disposed in the socket hole, wherein the bucket lip includes a slot traversing each socket hole and overlying the aft edge of the shank, and wherein each shank has a mounting hole aligned with the slot and having a center spaced from the aft end of the shank a distance substantially no greater than a diameter of the mounting hole, and including a retaining pin for each tooth extending through the slot and the mounting hole for demountably securing the teeth to the bucket lip.

16. A bucket wheel assembly according to claim 1 wherein longitudinal axes of the corner socket holes have an origin on a center axis of the common circular line.

17. A bucket wheel assembly according to claim 1 wherein the corner socket holes are regularly positioned along the common circular line.

18. An excavation bucket assembly comprising a generally trough-shaped bucket having an open forward end defined by a lip on the bucket which includes a multiplicity of forwardly open, side-by-side socket holes a plurality of which form corner socket holes, a set of corner teeth each having a shank disposed in a corner socket hole and a cutting portion integrally constructed with the shank, the cutting portion defining a forwardly oriented cutting edge and a soil lifting surface, a plurality of intermediate teeth mounted on the lip adjacent the corner holes, each intermediate tooth having a shank disposed in a corresponding one of the socket holes, the cutting edges of the corner teeth defining a portion of a cutting edge for the bucket, and means for demountably securing the teeth to the lip, wherein the lip has a relatively lower portion intermediate corners of the lip and lip sides which extend upwardly therefrom, wherein the bucket includes spaced-apart side plates extending rearwardly from the sides of the bucket lip, and including a first transverse bar extending between the side plates and located rearwardly and upwardly of the bucket lip corner and a second transverse bar extending between the side plates and located proximate the bucket lip corners, a multiplicity of chains each having a first end attached to the first bar and a second end attached to the second bar, each chain having a length greater than the distance between the bars, the number of chains being selected so that a combined width of the chains on the bars is less than a length of the bars, and means disposed between the bars for biasing portions of the chains at a location intermediate the bars into close proximity when the sides of the lip are in a generally upright position whereby, upon an inversion of the bucket during use, the chains gravitationally drop towards the forward end of the bucket and the portions of the chains biased into close proximity flare outwardly as the chains drop forwardly to facilitate a removal of material from inside the bucket.

19. A method of excavating soil with a bucket excavator including a rotating bucket wheel and a plurality of excavating bucket assemblies attached to and radially projecting from a periphery of the bucket wheel, each bucket wheel including a lip defining a forward end and mounting a multiplicity of excavating teeth including subsets of corner teeth, the excavating teeth projecting forwardly of the lip and being arranged to excavate soil along a cutting line defined by leading edges of the teeth and cause the transport of excavated soil into the bucket, the method comprising the steps of providing a plurality of subsets of corner teeth, the corner teeth of each subset of excavating teeth being shaped differently from the corner teeth of other subsets to provide the bucket with a different, predetermined, desired cutting line when different subsets of corner teeth are mounted to the lip, mounting a set of excavating teeth including a first subset of corner teeth to the lip and therewith excavating soil, observing the soil being excavated, upon observing a change in soil conditions discontinuing the excavating step, removing the first subset of corner teeth from the lip and replacing it with a second subset of corner teeth which provides another predetermined, desired cutting line better adapted for excavating under the changed soil condition than the cutting line formed by the first subset of corner teeth, and thereafter continuing the excavating step under the changed soil condition.

20. A method according to claim 19 wherein the step of providing subsets of differently shaped corner teeth comprises providing corresponding corner teeth of each set with like shafts for engaging cooperating, fixed holes in the lip, and generating the other, predetermined, desired cutting line for the second subset of corner teeth by changing a shape of cutting portions of the corner teeth relative to the associated shafts.

* * * * *